US007193185B2

(12) United States Patent
Fisher

(10) Patent No.: US 7,193,185 B2
(45) Date of Patent: Mar. 20, 2007

(54) MINI-OVEN

(75) Inventor: Gary Fisher, Goodlettsville, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 11/091,990

(22) Filed: Mar. 29, 2005

(65) Prior Publication Data

US 2005/0236386 A1 Oct. 27, 2005

(51) Int. Cl.
*A21B 1/00* (2006.01)
*A21B 1/22* (2006.01)
*F27D 11/00* (2006.01)

(52) U.S. Cl. ..... 219/394; 219/414; 219/477

(58) Field of Classification Search ..... 219/394
See application file for complete search history.

(56) References Cited

U.S. PATENT DOCUMENTS 3,176,118 A * 3/1965 Scott ..... 219/394
4,180,049 A * 12/1979 Carr et al. ..... 126/21 A
5,618,458 A * 4/1997 Thomas ..... 219/394
5,808,278 A 9/1998 Moon et al.
5,994,673 A * 11/1999 El-Shoubary et al. ..... 219/403
6,066,837 A 5/2000 McCormick et al.
6,157,008 A 12/2000 Brown et al.
6,166,353 A * 12/2000 Senneville et al. ..... 219/385
6,465,762 B1 10/2002 Swayne et al.
6,559,427 B1 5/2003 Barnes et al.
6,703,591 B2 3/2004 Daum et al.
6,710,308 B2 * 3/2004 Sauter et al. ..... 219/490
6,822,199 B2 11/2004 Boyer
6,917,016 B2 * 7/2005 Backer et al. ..... 219/392
2005/0167413 A1 * 8/2005 Ha ..... 219/394

FOREIGN PATENT DOCUMENTS

JP 02-140512 A * 5/1990

* cited by examiner

*Primary Examiner*—Joseph Pelham
(74) *Attorney, Agent, or Firm*—Pearne & Gordon LLP

(57) ABSTRACT

A cooking device includes a main oven, a controller for controlling the main oven, a mini-oven, and a control for controlling the mini-oven, wherein the control is in communication with the controller.

10 Claims, 3 Drawing Sheets

MINI-OVEN

BACKGROUND OF THE INVENTION

1) Field of the Invention

The present invention relates to ovens or ranges and, in particular, to a oven or range having an additional mini-oven.

2) Description of Prior Art

Ranges and ovens are examples of cooking devices found about homes and businesses. In the past these cooking devices have sometimes been provided with multiple ovens. This simply resulted in two ovens with two sets of controls. No variety of functions or new functions were provided and no efficiencies or increased capabilities were provided by the controls

SUMMARY OF THE INVENTION

In accordance with one aspect, the present invention provides a cooking device that includes a main oven, a controller for controlling the main oven, a mini-oven, and a control for controlling the mini-oven, wherein the control is in communication with the controller.

DESCRIPTION OF EXAMPLE EMBODIMENTS

Figure 1:
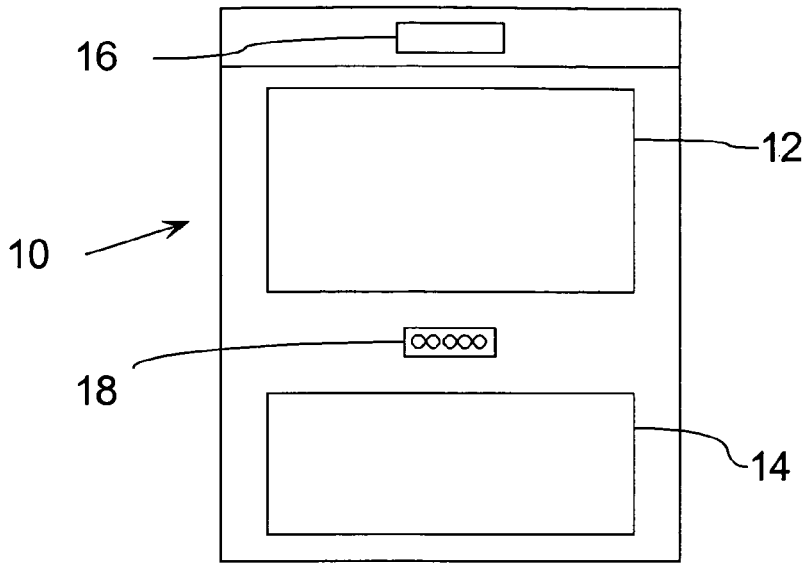
FIG. 1 is an example of a cooking device according to the invention.

Referring to FIG. 1, cooking device 10 includes a main oven 12 and a mini-oven 14. A controller 16 controls the main oven 12 and a control 18 controls the mini-oven 14. As will be more fully set forth below, the control 18 may be in communication with the controller 16. The one or both the controller 16 and the control 18 may be, for example, microprocessor operated control systems providing digital control of oven operations, for example, the application and degree of heat in the ovens. While the mini-oven is shown as being integral with the device 10, it is also within the scope of the invention for the mini-oven 14 to be freestanding but in communication with the rest of the device 10.

In order to maximize the functionality of the device 10, the mini-oven 14 can be operated in several states. For example, the mini-oven 14 can be operated as a typical oven, at a lower temperature as a warmer for food or dishes, at a further lower temperature for bread proofing or as a storage space by locking out any heating. It is also possible to refrigerate the contents or provide such features as microwave or convection cooking.

Figure 2:
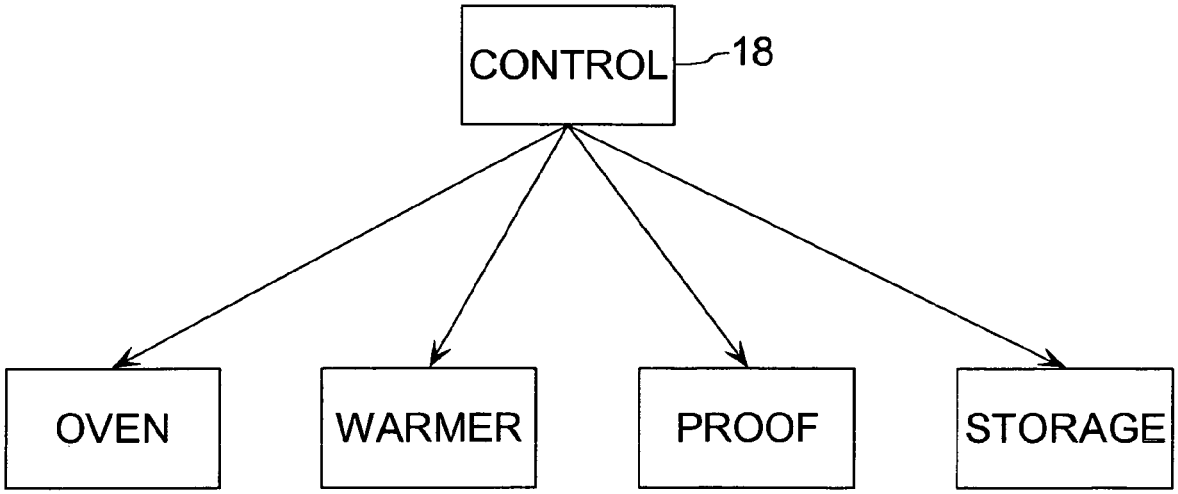
FIG. 2 is a block diagram of an example of a cooking device according to the invention.

Referring to FIG. 2, the above states may be selected by the control 18. The control 18 may include, for example, one or more selector switches or potentiometers having rotary dials or a matrixed switch such as commonly available membrane matrixed switches.

The control 18 may advantageously be in communication with the controller 16. For example, a traditional wiring type connection may be made or such modern technologies as two or three wire network buses. By using a bus type connection, it is possible to easily use the controller 16 for much of the actual control of the mini-oven 14 via the control 18. In a case where the controller 16 is a digital electronic controller, it is cost efficient to have most of the computing power in the controller 16 and to use the control 18 largely just for control inputs and display of status. For example, the control 18 may have a segmented numerical display or one or more discrete lights (e.g., 32 LEDs).

Figure 3:
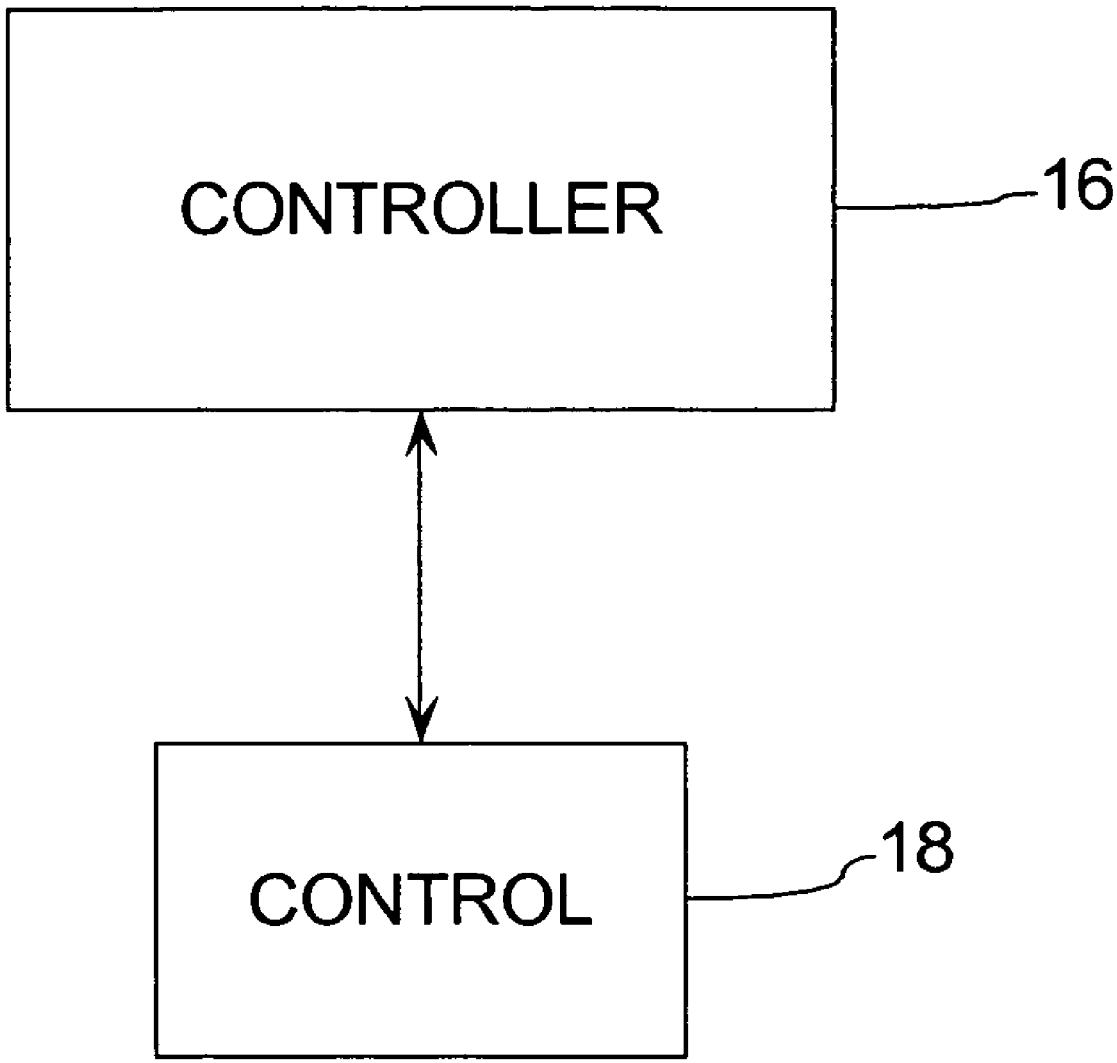
FIG. 3 is another block diagram of an example of a cooking device according to the invention.
Figure 4:
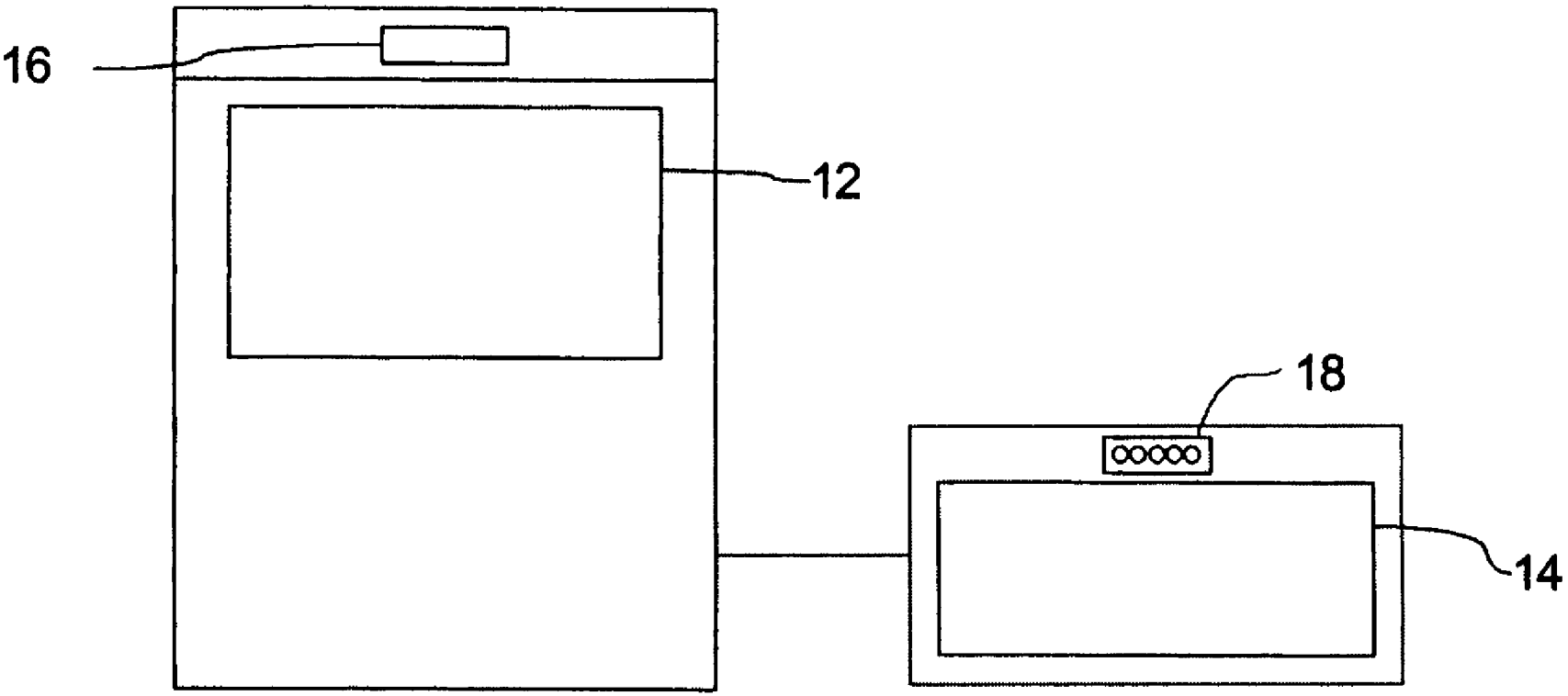
FIG. 4 is an example of a cooking device according to the invention having a free-standing mini-oven.

Referring to FIG. 3, the controller 16 may, for example, put the control 18 and mini-oven 14 in states such as: demo mode where all indicators work, but no heating takes place; factory test mode where the device is put into a rapid test mode; lockout mode where the main oven is in a state that is incompatible with operation of the mini-oven (e.g., in a self-cleaning cycle); diagnostic mode where status and operating data is sent to the controller 16 from the control 18; engineering mode where special troubleshooting/development data is sent to the controller 16; and failure report mode where information on failures is sent to the controller 16.

The controls of the mini-oven area can be located away from or located close to the controls of the main oven or other functions such range-top burners.

The control 18 may use, for example, a 1,000 ohm platinum thin film resistive device for sensing the internal cavity temperature.

Provisions also may be made for the control 18 to sense, for example, door status inputs or thermal disk input.

When using digital implementations, features of the control 18 may be configured based on values in a EEPROM used as part of the circuitry.

The control 18 may also control, for example, a convection fan, oven light or broil element.

It should be evident that this disclosure is by way of example and that various changes be made by adding, modifying or eliminating details without departing from the fair scope of the teaching contained in this disclosure. The invention is therefore not limited to particular details of this disclosure except to the extent that the following claims are necessarily so limited.

What is claimed is:

1. A cooking device comprising:

a main oven;

a controller for controlling said main oven;

a mini-oven; and a control for controlling said mini-oven, wherein said control is in communication with said controller and said controller is adapted to place said control in any of a plurality of operating modes.

2. A device according to claim 1, wherein said controller is adapted to place said mini-oven in at least one of a demo mode, a factory test mode, a lockout mode, a diagnostic mode, an engineering mode and a failure report mode.

3. A device according to claim 1, wherein said mini-oven is selectable to be in an oven state, a warmer state, a bread proofing state and a storage state.

4. A device according to claim 1, wherein said mini-oven is in a drawer configuration.

5. A device according to claim 1 wherein said mini-oven is free standing with respect to said main oven.

6. A device according to claim 1, wherein said control includes a rotary dial.

7. A device according to claim 1, wherein said control includes a potentiometer.

8. A device according to claim 1, wherein said control includes a matrixed switch.

9. A device according to claim 1, wherein said control includes a numerical display.

10. A device according to claim 1, wherein said control includes status lights.

* * * * *